US008777766B2

(12) United States Patent
Burger

(10) Patent No.: US 8,777,766 B2
(45) Date of Patent: Jul. 15, 2014

(54) ROTATING WATER AMUSEMENT RIDE

(75) Inventor: Guenter Burger, Waldkirch (DE)

(73) Assignee: Mack Rides GmbH & Co. KG, Waldkirch (DE)

( * ) Notice: Subject to any disclaimer, the term of this patent is extended or adjusted under 35 U.S.C. 154(b) by 97 days.

(21) Appl. No.: 13/509,995

(22) PCT Filed: Nov. 17, 2010

(86) PCT No.: PCT/EP2010/007001

§ 371 (c)(1), (2), (4) Date: May 30, 2012

(87) PCT Pub. No.: WO2011/060927

PCT Pub. Date: May 26, 2011

(65) Prior Publication Data

US 2013/0130812 A1 May 23, 2013

(30) Foreign Application Priority Data

Nov. 17, 2009 (DE) ..... 10 2009 053 439

(51) Int. Cl.
*A63G 31/02* (2006.01)
*A63G 31/00* (2006.01)

(52) U.S. Cl.
USPC ..... 472/128; 472/129

(58) Field of Classification Search
CPC ..... A63G 3/00; A63G 3/06; A63G 21/04; A63G 21/08; A63G 31/00; A63G 31/02; A63H 23/10
USPC ..... 472/13, 128, 129; 104/53, 69, 70, 73
See application file for complete search history.

(56) References Cited

U.S. PATENT DOCUMENTS

| | | | | | |
|---|---|---|---|---|---|
| 604,164 | A * | 5/1898 | Wilde et al. | ..... | 472/13 |
| 1,448,306 | A | 3/1923 | Lezert | | |
| 1,510,941 | A * | 10/1924 | Jones | ..... | 472/13 |
| 1,838,300 | A | 12/1931 | Di Leonardo | | |
| 4,149,469 | A | 4/1979 | Bigler | | |
| 5,197,923 | A | 3/1993 | Barber | | |
| 8,091,483 | B1 * | 1/2012 | Sumner | ..... | 104/73 |
| 2006/0111195 | A1 | 5/2006 | Henry | | |

FOREIGN PATENT DOCUMENTS

| | | |
|---|---|---|
| DE | 1 780 962 | 8/1959 |
| DE | 69 40 587 | 10/1969 |
| DE | 37 12611 | 4/1987 |
| DE | 10 2006 053 664 | 1/2008 |
| GB | 211 668 | 2/1924 |
| JP | 5023440 | 2/1993 |

* cited by examiner

*Primary Examiner* — Kien Nguyen
(74) *Attorney, Agent, or Firm* — TechLaw LLP

(57) ABSTRACT

An amusement ride in the form of a boat regatta having a water-filled basin and boats traveling thereon with their own drive, where there is arranged in the basin a raisable platform which allows the boats to travel in the lowered position and lifts the boats out of the water in the travel breaks.

19 Claims, 8 Drawing Sheets

ROTATING WATER AMUSEMENT RIDE

Figure 1:
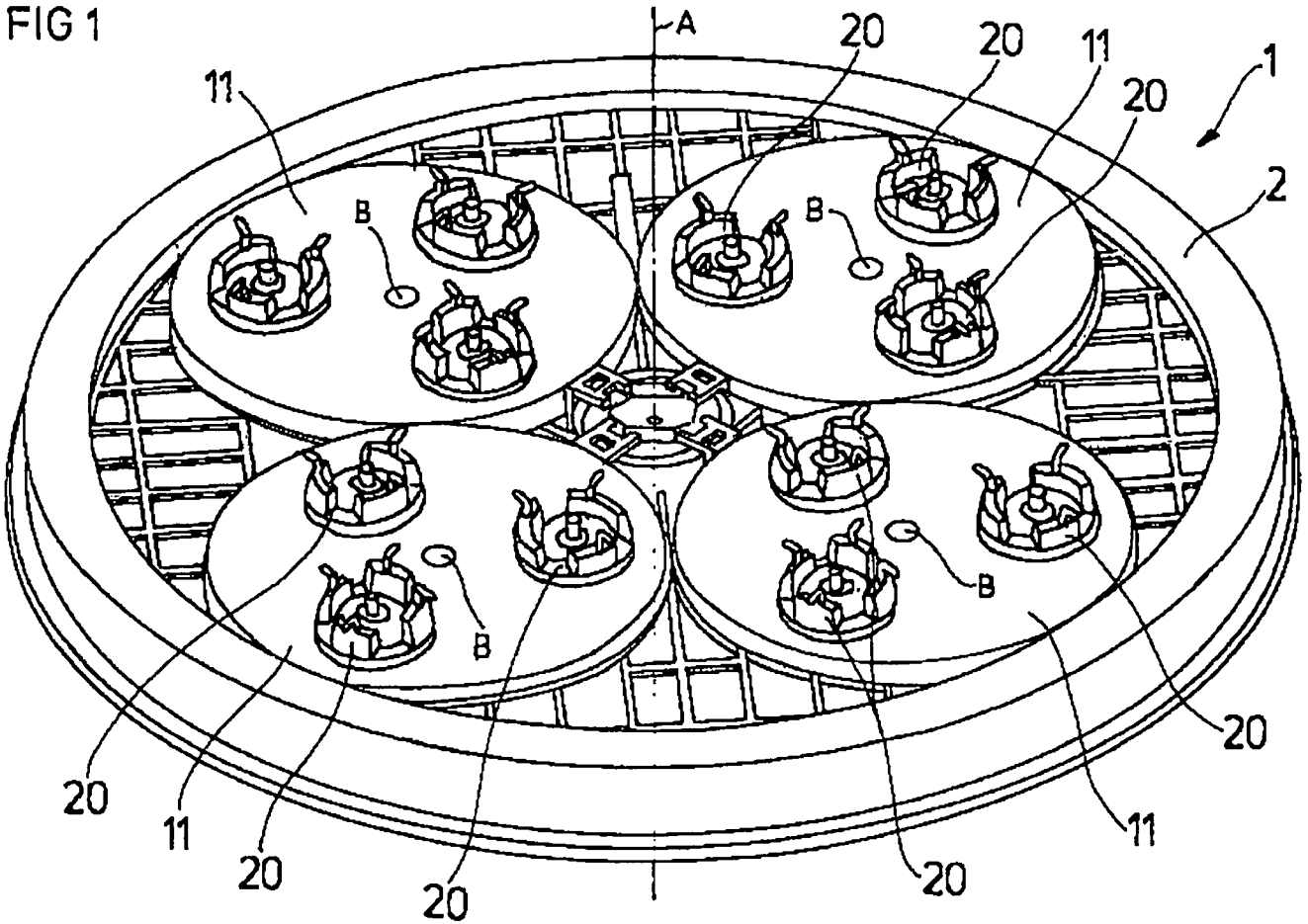

The invention relates to a water amusement ride, having a water vessel which is preferably moved in the body of water, and having a float body which is borne by the water and which has seats for accommodating passengers.

A water amusement ride of said type is known for example from DE 10 2004 062 315 A1. The float body which is borne by the water is articulatedly connected to an undercarriage, which is guided by a rail arranged on the floor of the body of water, in such a way that said float body can perform limited transverse and/or lifting movements relative to the undercarriage. Here, the undercarriage is, in one embodiment, pulled through the body of water by means of a cable pull guided over diverting rollers. Said water amusement ride is thus a water amusement ride which is equipped with rails and in which the individual water vessels travel along the rail profile in a type of stream bed.

For such rail-bound water vessels, DE 10 2006 053 664 B3 describes the provision, under the water vessel, of a special float body which is rotatably mounted on a frame. On the underside of the float body, a paddle wheel which is connected to said float body is arranged such that the float body is set in rotation as it travels through the body of water. Passengers can board said water vessels via a special landing platform at the stopping point of the water amusement ride, wherein the water vessels must dock smoothly at said stopping point.

A further water amusement ride which is reliant on rails which run within a stream or river bed is described in EP 1 671 686 B1. There, the float body and the undercarriage are coupled to one another via coupling elements. The coupling elements ensure that the float body is fixed after the sinking of the undercarriage of the water vessel.

A rotating water amusement ride, specifically a water carousel, is known from CH 183488. Said rotating water amusement ride has a float body with seats for accommodating passengers. Here, the float body is formed as an annular, buoyant shell in which seats for accommodating people are arranged. Here, the annular float body may be mounted so as to be rotatable about a mast or an anchor in the water and arranged so as to be rotatable about its fastening point by means of rudders or by means of an auxiliary motor. On the outer edge of the float body there may be provided, for example, an oblique board from which the bathers may, in the event of sufficiently fast rotation, slide into the water. Furthermore, ropes or rings may be attached to the float body in order that people swimming in the water can be pulled along. Access to the seats provided in the float body is realized by means of a drawbridge which the passengers must cross.

It is the aim of the present invention to provide a rotating water amusement ride in which the passengers can in a simpler manner walk to their seats in the water vessels while keeping their feet dry.

Said aim is achieved by means of a rotating water amusement ride having the features of claim 1.

The subclaims relate to refinements of the invention.

The invention is thus based substantially on the concept of providing a single-part or multi-part platform, in particular a rotary plate, which, in a rest state of the water amusement ride, protrudes out of the water surface such that the passengers can walk to their water vessels.

In one refinement of the invention, the platform may be formed in multiple parts and may rotate. It has for example proven to be expedient to provide, on a preferably circular platform, a plurality of smaller circular individual platforms. Here, both the large platform and also the individual platforms may be set in rotation.

In one particular refinement of the invention, it is provided that a single drive serves to provide the rotational movement of the entire water amusement ride, that is to say of the platform and of the individual platforms which may be provided. Here, the drive may be formed as a toothed ring drive or toothed belt drive or else as a cable pull drive. The entire arrangement may be constructed in the manner of a planetary gear set, with the individual sun gears corresponding to the individual platforms.

On each of the individual platforms there are situated preferably a plurality of water vessels with their respective float bodies, wherein the water vessels themselves in turn rotate. The rotation of the water vessels is preferably realized without a drive, that is to say without motor-powered drive. For this purpose, the water vessels have, on the underside of their float body, the paddle wheels known from DE 10 2006 053 664. Here, when the water amusement ride is in the operating state, the water vessels are duly fixed axially but, during the rotation of the individual platforms, can rotate without motor-powered drive owing to the associated movement of the paddle wheels in the water.

In another refinement of the invention, it is provided that the water vessels, in the rest state, that is to say when the platform protrudes out of the water surface, are fixed. Such fixing of the water vessel in the rest state of the water amusement ride ensures that the passengers can safely walk onto the water vessel because the latter no longer pivots and also no longer rotates.

Even though the platform, in the rest state, may be raised out of the water in any desired manner, it also falls within the invention, instead of raising the platform, to lower the water level in the water amusement ride such that said water level lies at the height of the platform or preferably slightly below the platform. Then, too, the passengers can walk to the individual water vessels while keeping their feet dry.

A particularly simple way of raising the platform out of the water surface consists for example in raising wedges being pushed under the platform at the end of an operating run of the water amusement ride, such that subsequent further slow rotation of the platform and simultaneous further radial insertion of the raising wedges under the platform causes the platform to be raised along the slopes of the raising wedges. The particular advantage of such an arrangement lies in the fact that the raising of the platform is realized simultaneously with a slow onward rotation of the platform. The individual wedges must merely be pushed radially under the platform from the outside. Raising of the platform is however also possible by virtue of only the raising wedges being pushed slowly under the platform without rotation of said platform. When the passengers have boarded or alighted from the water vessels and it has been ensured that no more passengers are standing on the platform or on the individual platforms, the sliding wedges can be slowly pulled out from under the platform or individual platforms again such that the platform or individual platforms can sink below the water level again.

The raising and lowering of the platform or individual platforms may self-evidently also be realized by means of any other suitable raising device. According to a further proposal of the invention, the raising device may be composed of at least one run-on ramp, which is arranged under the platform and which extends in the direction of rotation, and of at least one supporting wheel, which is assigned to the platform and which can be displaced radially such that, during a further rotation of the platform, it runs onto the run-on ramp, whereby the platform is raised above the water surface.

It has proven to be expedient for the platform and/or the individual platforms to be provided in each case with a multiplicity of openings such that, when the platform is raised or the water level in the water amusement ride is lowered, the platform poses the least possible resistance. Here, assuming the same force, the platform can be raised more quickly or the water level can be lowered more quickly, because the water can also flow out through the openings of the platform.

As already mentioned further above, the float bodies of the water vessels have paddle wheels which, during the movement of the platform or of the individual platforms and with the flow thereby generated, ensure an automatic rotation of the water vessel. Said effect can be further intensified by virtue of a flow-generating system, in particular flow-generating pumps, being provided below the water level of the water amusement ride, which flow-generating pumps discharge below the platform in the direction of the individual water vessels and the paddle wheels arranged thereon. As the individual water vessels pass said flow-generating pumps, the rotation effect of the water vessels is intensified.

The water amusement ride according to the invention with its rotating platforms, under which the rotary mechanism is arranged, and with the capsize-proof suspension of the water vessels and with the limited water depth offers a high level of safety because the risk of injury to or even drowning of passengers who fall into the water is hereby practically eliminated.

Figure 2:
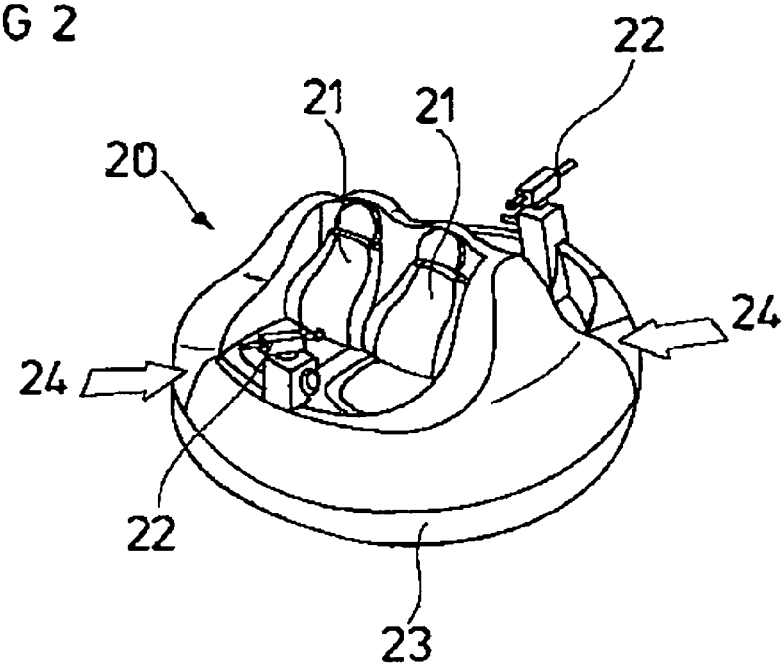
Figure 3A:
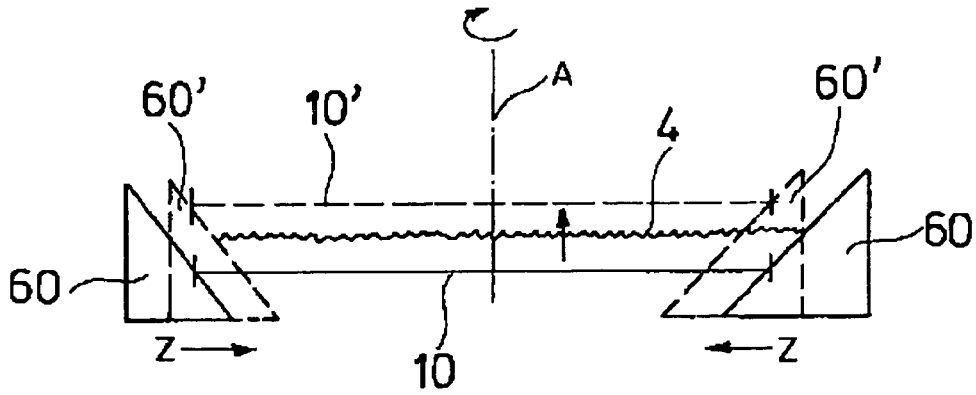
Figure 3:
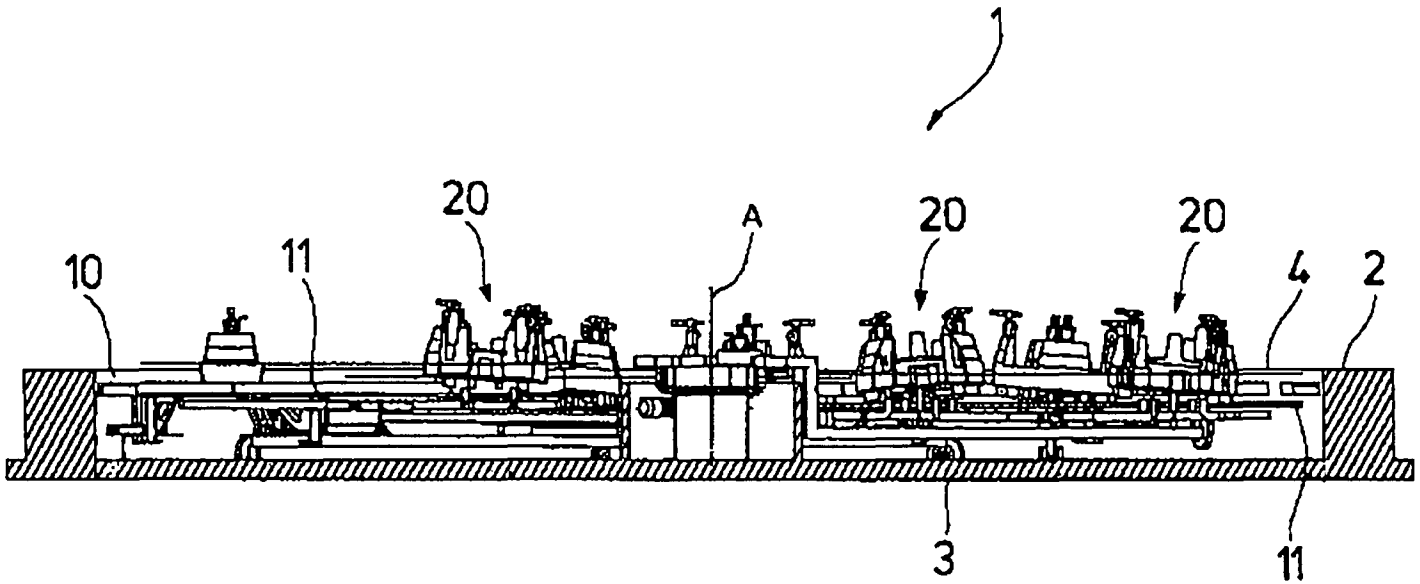
Figure 4:
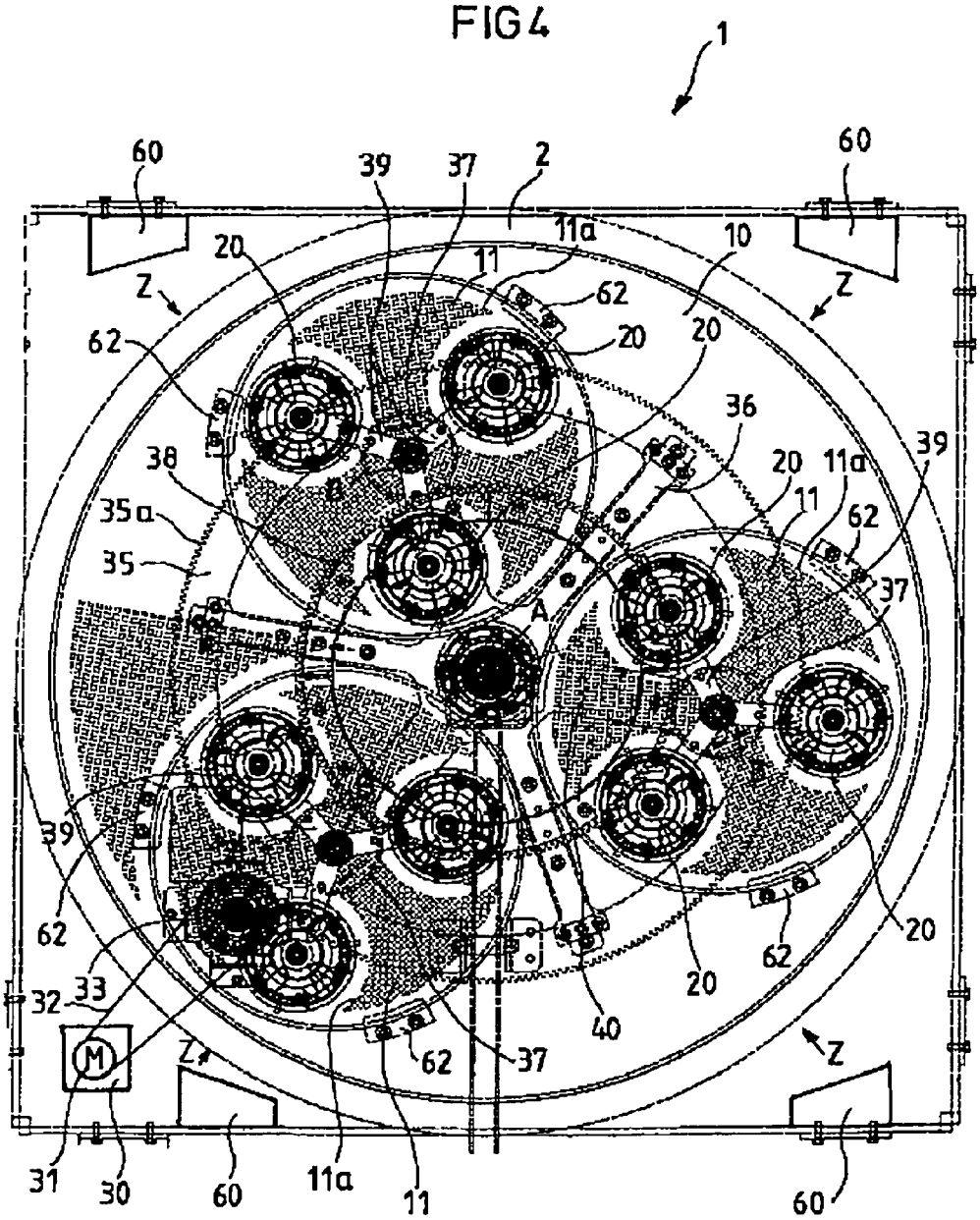
Figure 5:
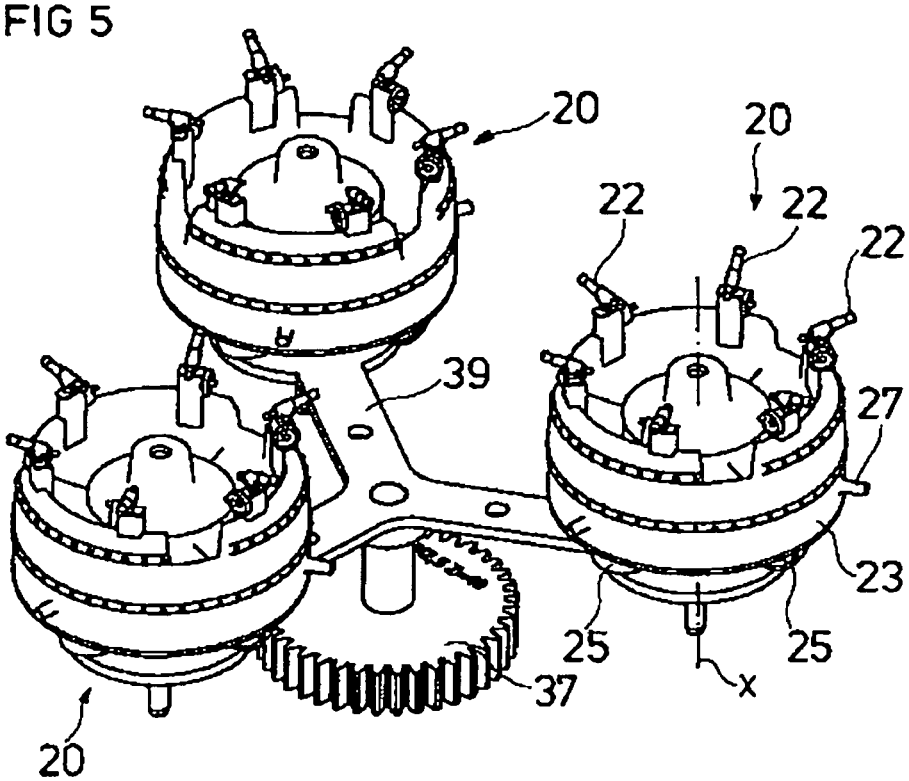
Figure 6:
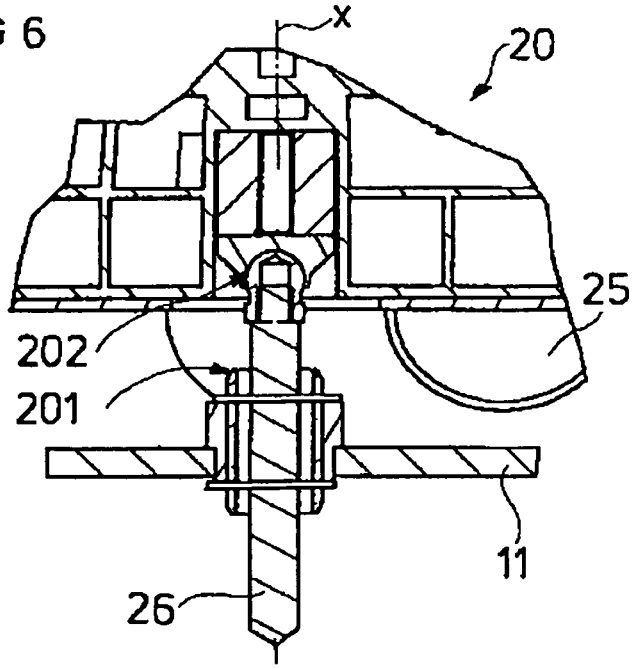
Figure 9:
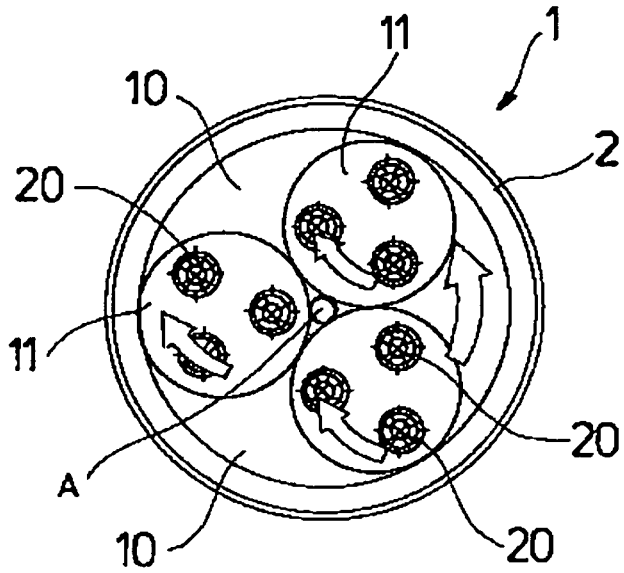
Figure 10:
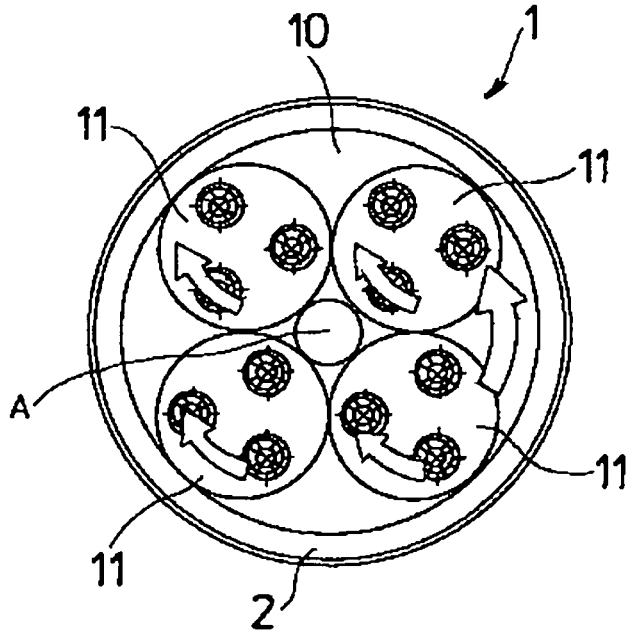
Figure 11:
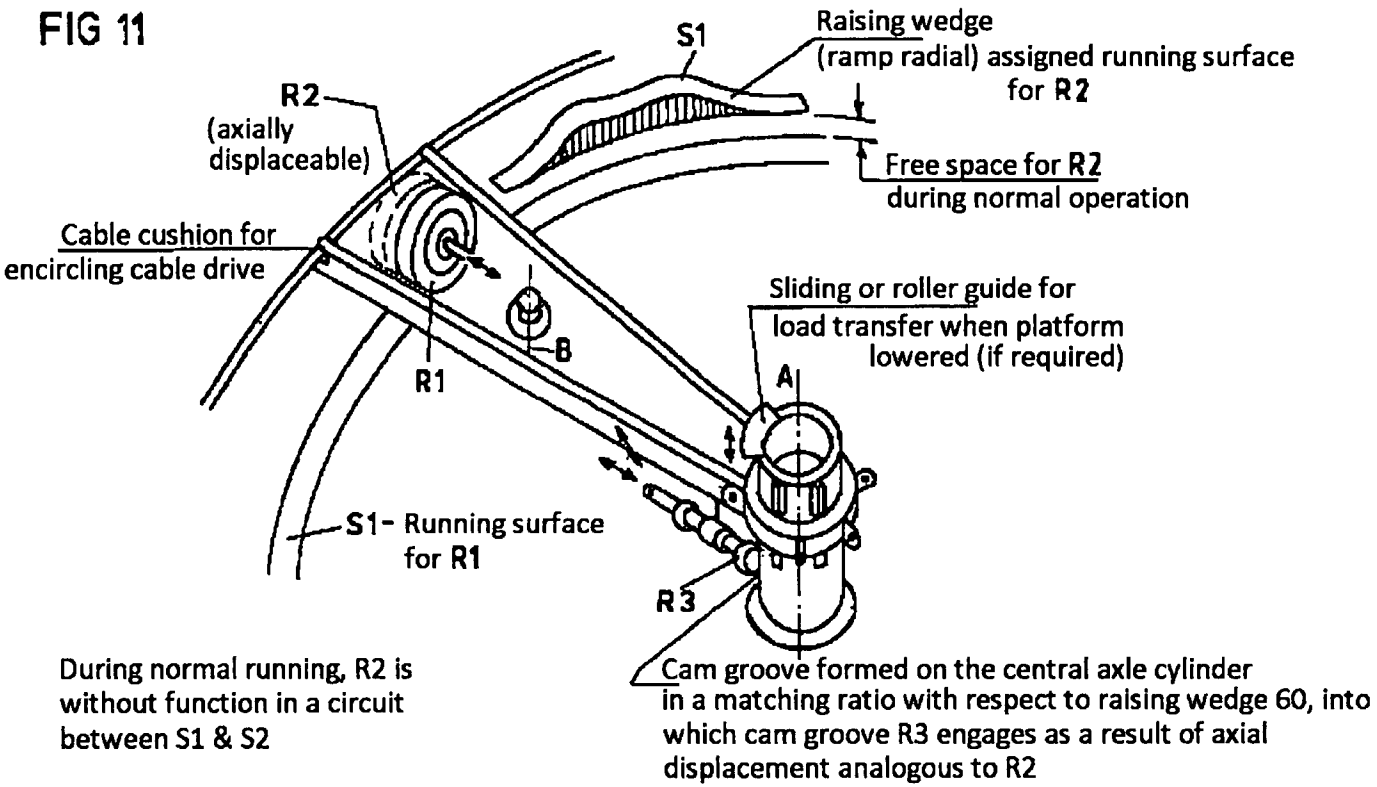

The rotating water amusement ride according to the invention will be explained in more detail below in conjunction with multiple figures, in which:

FIG. 1 shows a first exemplary embodiment of a rotatable water amusement ride having a rotating platform and having four rotating individual platforms on which in each case three water vessels are arranged, FIG. 2 shows an exemplary embodiment of a four-seat water vessel, FIG. 3 shows the water amusement ride from FIG. 3 in a side view, FIG. 3*a* shows a diagrammatic illustration of a platform, situated above and below the water surface, with raising wedges, FIG. 4 shows the basic design of a further exemplary embodiment of a rotatable water amusement ride having three individual platforms which rotate relative to one another, FIG. 5 shows a detail view from FIGS. 3 and 4 with a holding device for three water vessels, FIG. 6 shows a detail of the mounting point of a water vessel on an individual platform, FIGS. 7 to 10 show different variants of possible platforms of the rotating water amusement ride, and FIG. 11 shows a detail of the physical realization of a raising mechanism.

In the following figures, identical parts of identical function are denoted by the same reference symbols, unless stated otherwise.

FIG. 1 is a perspective illustration of an exemplary embodiment of a rotating water amusement ride. The water amusement ride is denoted generally by the reference numeral 1. The water amusement ride has a circular outer contour with a rim 2. Within said rim 2 there is situated a rotating platform 10 which extends into the vicinity of the rim 2 of the water amusement ride 1. Said platform 10 is formed as a rotary plate and can rotate, for example clockwise, about the central axle A under the action of suitable drive means to be explained below. On or within said platform 10 or said rotary plate there are situated a plurality of, in the illustrated exemplary embodiment four, individual platforms 11 which are likewise arranged so as to be rotatable about their respective axle. The rotation axles of the individual platforms 11 are denoted by the reference symbol B. As can be seen, the individual platforms 11 are in turn formed as rotary plates. Under the action of suitable drive means, said individual platforms 11 rotate preferably in the opposite direction to the platform 10, that is to say in this case for example counterclockwise.

The individual platforms 11 hold a plurality of water vessels 20. Such water vessels are already known per se for example from DE 10 2006 053 664 B3 as cited in the introduction. Said water vessels 20 are positioned in a distributed manner on the individual platforms 11 and can likewise rotate about their respective axle, in a way to be explained below.

FIG. 2 shows an exemplary embodiment of a suitable water vessel. The water vessel has a suitable float body 23 on which are arranged a plurality of seats 21 for passengers. The number of seats is arbitrary and is dependent only on the size of the installation. The water vessels 20 may be equipped with spray guns 22 in order to increase ride enjoyment and fun. The water vessels 20 expediently have an encircling rim into which recesses 24 are formed in order to make it easier for passengers to board and alight from the water vessel 20.

During operation of the ride, that is to say when the platform 10 is rotating and likewise the individual platforms 11 and preferably also the water vessels 20 are rotating, the water amusement ride 1 is filled with water within the rim 2 to such a level that only the water vessels 20 protrude with their seats out of the water surface. The passengers are thus given the impression that the individual water vessels 20 are floating on the water surface, and that there are no further holding elements.

However, to make it possible for the passengers to walk to the individual water vessels 20 while keeping their feet dry, means are provided such that, when the water amusement ride is in the rest state, that is to say when the platform 10 and also the individual platforms 11 are no longer rotating, the water level lies below the platform 10 and below the individual platforms 11. This may on the one hand be achieved by virtue of the water which is situated in the water amusement ride 1 being drained to such an extent that the water level lies below the platform 10 or the individual platform 11. It is however likewise possible for a suitable raising device to be provided which raises the platform 10 and the individual platforms 11 together with the water vessels 20 above the water level.

Such a raising device will be described in schematic terms on the basis of FIGS. 3 and 3*a*. FIG. 3 shows the rotating water amusement ride from FIG. 1 in section, wherein the water level 4 is situated above the platform and above the individual platforms 11. If the water level 4 is situated above the platform 10 and the individual platform 11, the water amusement ride is in an operationally ready state, that is to say is ready for ride operation. The platform 10 and the individual platforms 11 can rotate. In this operating state, the individual water vessels 20 appear to be floating on the water surface 4.

FIG. 3*a* shows a schematic sketch of said operating state. The platform 10 is situated below the water surface 4. Here, the platform 10 is supported, at the edge, on a slope of raising wedges 60. To now raise the platform 10 above the water surface 4 and thereby place the water amusement ride 1 into its rest state, in which the passengers can walk to or away from the individual water vessels 20 while keeping their feet dry, the raising wedges 60 are moved toward one another along the illustrated arrows Z by means of a suitable advancing device. A movement of the raising wedges 16 toward one another has the effect that the platform 10, which is supported at the edge on the raising wedges 60, moves upward along the slopes of the raising wedges 60. Here, the raising wedges 16 are moved toward one another to such an extent that the platform 10 protrudes out of the water surface 4 and comes to rest in a position shown by dashed lines 10' in FIG. 3*a*. The end position of the raising wedges 60 is likewise indicated by raising wedges 60' illustrated by dashed lines. The raising of the platform 10 may take place when the platform 10 is stationary or else when the platform 10 is rotating about the axle A.

Although not illustrated in FIG. 3*a*, the platform 10 has a multiplicity of openings in order to keep the water resistance during the raising of the platform 10 as low as possible.

FIG. 4 shows a plan view of the embodiment of a further possible rotatable water amusement ride in which three rotating individual platforms 11 are arranged on a rotating platform 10, wherein the individual drive components are clearly visible. The water amusement ride 1 illustrated in FIG. 4 has the already described rim 2, within which the rotating platform 10 is arranged. Said rotating platform 10 extends into the vicinity of the rim 2 of the water amusement ride 1. The platform 10 is seated on a rotary star 36 and is fixedly connected thereto. Said rotary star 36 is centrally mounted so as to be rotatable about the axle A, and is fixedly connected, for example by means of screw connections, to a first toothed ring 35. Said first toothed ring 35 is, in the illustrated exemplary embodiment, provided with a toothing 35*a* facing toward the rim 2. Said toothing 35*a* meshes with a first toothed wheel 33 which is arranged between the rim 2 and the first toothed ring 35. Said first toothed wheel 33 is furthermore coupled via a belt 32 or cable pull to a motor 31 of a drive device 30. A rotation of the motor 31 of the drive device 30 causes a rotation of the toothed wheel 33, as a result of which the first toothed ring 35 together with rotary star 36 situated thereon and platform 10 fastened thereto are set in rotation.

The platform 10 has disk-shaped cutouts which are arranged at an angle of 120° with respect to one another and in which individual platforms 11 are situated. The individual platforms 11 are in turn formed as rotary plates and each have their own central rotation axle B. Each of the three rotation axles B is mounted, by means of a second rotary star 40, so as to be rotatable about the rotation axle A of the water amusement ride 1. The second rotary star 40 is arranged fixedly with respect to the first rotary star 36. The two rotary stars 36 and 40 may also be formed in one piece.

Furthermore, below each of the individual platforms there is situated a third rotary star 39. Said third rotary stars 39 have in each case three holding rods arranged at an angle of 120° with respect to one another, to the ends of which holding rods the respective water vessels 20 are fastened in a way to be explained below. The third rotary stars 39 of each individual platform 11 are connected in a rotationally conjoint manner to the respective individual platform 11.

The rotation of the individual platform 11 is achieved by virtue of a second toothed wheel 37 being fastened in a rotationally conjoint manner to the axle B of each individual platform 11, as illustrated in FIG. 5. Said second toothed wheel 37 meshes with a second toothed ring 38 which is arranged between the center, that is to say the axle A, and the first toothed ring 35. Since the second rotary star 40 is formed fixedly with respect to the first rotary star 36, a rotation of the platform 10 automatically leads to a rotation of the second rotary star 40 about the axle A. Because the individual platforms 11 are fixed to the end of the respective holding arms of the rotary star 40, the individual platforms 11 likewise move about the axle A. The movement of the individual platforms 11 about the axle A in turn leads, as a result of the meshing engagement of the second toothed wheels 37 with the positionally fixed second toothed ring 38, to a rotation of the rotary stars 39 about the axle B.

Therefore, if the motor 31 of the drive device 30 is set in motion by being supplied with electrical current, this leads, via the first toothed wheel 33, to the rotation of the first toothed ring 35 and therefore automatically to the rotation of the platform 10. At the same time, the individual platforms 11 rotate about the axle A, and the water vessels 20 simultaneously rotate about the axles B of the respective individual platforms 11. Said rotation of the individual components is realized with only a single drive device 30, which is preferably arranged, as illustrated in FIG. 4, outside the rim 2 of the water amusement ride 1 and which is therefore easier to service than drives which are situated under the water amusement ride 1.

Any desired raising devices may be provided for raising the platform 10. In the exemplary embodiment of FIG. 4, four raising wedges 60 are indicated outside the water amusement ride 1, which raising wedges can be moved in the movement direction Z which runs radially with respect to the axle A. An insertion of the raising wedges 60 in the manner already explained causes the platform 10 to be raised such that the platform 10 can protrude out of the water surface of the amusement ride. Raising of the platform 10 automatically also leads to raising of the individual platforms 11. This is achieved by means of coupling elements 62 which are fastened to the edge of the circular cutouts of the platform 10 and which engage in the manner of lugs under the individual platforms 11. The coupling elements 62 are arranged for example at intervals of 120° with respect to one another on the circular openings into which the individual platforms 11 are inserted. Said coupling elements 62 engage under the individual platforms 11 when the platform 10 is raised, and carry the individual platforms along with the platform 10 as it is raised, such that the individual platforms 11 are likewise raised without the need to provide separate raising means under the individual platforms 11.

To minimize the water resistance during the raising of the platform 10 and of the individual platforms 11, both the platform 10 and also the individual platforms 11 have a multiplicity of openings 11*a* through which the water can flow. For clarity, the multiplicity of openings in the platform 10 has not been illustrated in FIG. 3.

FIG. 5 and FIG. 6 show details of the fastening of the individual water vessels 20 to the rotary star 39 or to the holding arms of said rotary star 39. Each of the water vessels 20 in FIG. 5 is designed for six people and, for this purpose, also has six spray guns 22. The float body 23 of each water vessel 20 is provided, on its underside, with the already mentioned paddles 25 which have the effect that, during a rotating movement of the rotary star 39, each water vessel 20 also rotates about its own axis X. Each of the water vessels 20 has a fastening bolt 26. Said fastening bolt 26 is arranged in a bearing 201 so as to be movable along the axis X. The bearing 201 is located in an opening of the individual platform 11. At its upper end, the fastening bolt has an articulated bearing 202 about which the water vessel 20 can rotate and also tilt by a predefined angle. In this way, a passenger is given the impression, when the water vessel 20 floats on the water surface, that the water vessel is apparently freely movable.

As a result of the arrangement illustrated in figure and the arrangement with free displaceability in the direction of the axis X, the water vessel 20 floats when it sets down on water.

FIG. 5 also shows a plurality of retaining bolts 27 which extend radially out of the float body 23 of the water vessel 20. Said retaining bolts 27 are such that, when the individual platforms 11 are raised out of the water surface, the bolts 27 rest on openings within the individual platforms and can be supported there. Securing and fixing of the water vessels 20 when the water amusement ride 1 is in the rest state is thus ensured.

Figure 7:
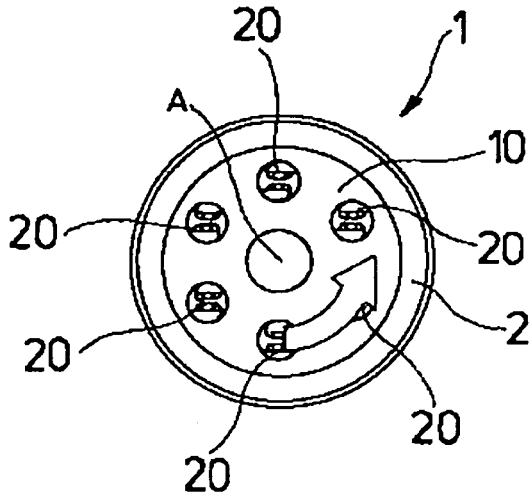

FIGS. 7 to 10 show diagrammatic illustrations of different variants of the rotatable water amusement ride 1 according to the invention. The reference symbols already known are used again here. FIG. 7 illustrates merely a single rotating platform 10 on which a plurality of water vessels 20 are arranged.

Figure 8:
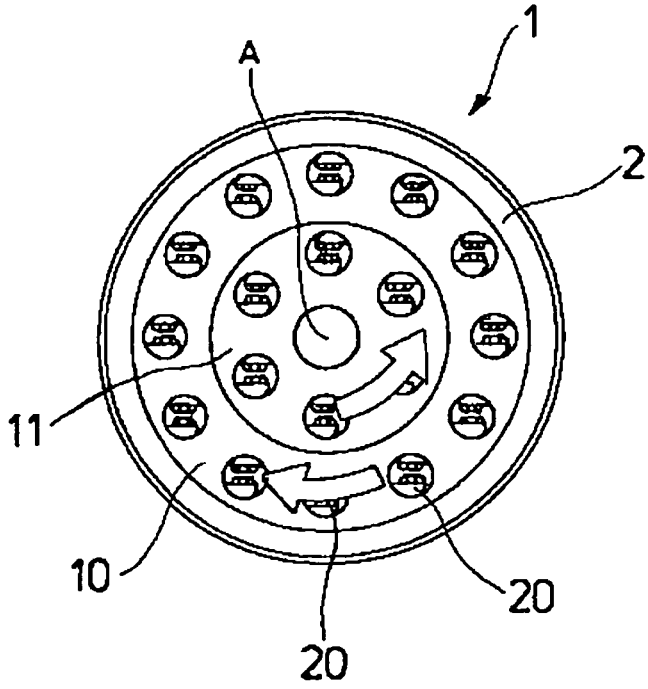

FIG. 8 shows a rotating water amusement ride 1 having a rotating platform 10 within which is situated one second, circular individual platform 11. The platform 10 and the individual platform 11 move, in accordance with the arrows illustrated in FIG. 8, in opposite directions during the operation of the water amusement ride.

FIG. 9 shows the illustration of FIG. 3 in a plan view, and FIG. 10 shows an illustration similar to FIG. 9, but in this case four rotating individual platforms 11 are provided.

FIG. 11 shows a specific embodiment regarding the way in which the platform 10 or 11 can be raised. The raising parts are in this case arranged radially. The raising parts have a run-on portion, a plateau with a securing depression, and a run-off portion. R1 denotes a supporting wheel for a jib of the platform 10 and for holding the axle B of an individual platform 11. When the main platform 10 is set in motion, the individual platform 11 is positively likewise set in rotation by means of the supporting wheel R1, which simultaneously serves as a drive for said individual platform. For the vertical load transfer via the supporting wheel R1, an encircling rail S1 is provided. Situated in a parallel circuit are the radially arranged raising wedges 16 in the form of ramps having a run-on portion, a plateau with a securing depression, and a run-off portion. During the final revolution of a run, a wheel R2 which is mounted on a centrally displaceable axle is displaced into the corresponding circuit. The special effect of such a solution lies in the fact that, for the displacement of the stroke wheel R3, only the force for overcoming the friction resistance of the respective axles is required. It must also be mentioned that, during a normal run of the water amusement ride, the axially displaceable wheel R2 has no function, and is situated in a circuit between the running surface S1 and the running surface S2 of the raising wedge.

List Of Reference Symbols

1 Water amusement ride
2 Rim
3 Base
4 Water level, water surface
10 Platform
10' Elevated platform
11 Individual platform
11*a* Openings
20 Water vessel
21 Seat
22 Spray gun
23 Float body
24 Recess
25 Paddle wheel
26 Fastening bolt
27 Retaining bolt
201 Bearing
202 Articulated bearing
30 Drive device
31 Motor
32 Belt, cable pull
33 First toothed wheel
35 First toothed ring
35*a* Toothing
36 Rotary star
37 Second toothed wheel
38 Second toothed ring
39 Rotary star
40 Rotary star
60 Raising wedge
60' Displaced raising wedge
62 Coupling element
A Rotation axle of the platform
B Rotation axle of the individual platform
X Axis of the water vessel
P Arrow
Z Movement direction

The invention claimed is:

1. A water amusement ride, comprising:

at least one water vessel which is movable in a body of water, and which has seats for accommodating passengers;

a platform which, in a rest state of the water amusement ride, protrudes out of the water surface of the body of water and which, in an operating state, lies below the water surface; and a drive coupled via a belt to the platform or the individual platforms.

2. The water amusement ride of claim 1, wherein the platform is formed in multiple parts.

3. The water amusement ride of claim 2, wherein the platform has a plurality of rotating individual platforms.

4. The water amusement ride of claim 3, wherein the water amusement ride is driven by a single drive which is arranged outside the platform.

5. The water amusement ride of claim 2, wherein the platform is arranged so as to rotate.

6. The water amusement ride of claim 1, wherein the platform is arranged so as to rotate.

7. The water amusement ride of claim 6, wherein the platform has a plurality of rotating individual platforms.

8. The water amusement ride of claim 6, further comprising: a raisins device which raises the platform and/or the individual platform out of the water surface in the rest state.

9. The water amusement ride of claim 1, wherein the water amusement ride is driven by a single drive which is arranged outside the platform.

10. The water amusement ride of claim 1, wherein the drive is coupled to a toothed ring which drives the platform or the individual platforms.

11. The water amusement ride of claim 10, wherein the drive is coupled via a belt to the platform or the individual platform.

12. The water amusement ride of claim 1, wherein the water vessels, in the rest state, are fixed with their respective float body to the platform or to the individual platforms, and, in the operating state, are released such that they can perform a rotational movement and/or tilting movement.

13. The water amusement ride of claim 12, further comprising: a raising device which raises the platform and/or the individual platform out of the water surface in the rest state.

14. The water amusement ride of claim 1, further comprising: a raising device which raises the platform and/or the individual platform out of the water surface in the rest state.

15. The water amusement ride of claim 14, wherein the raising device provides raising wedges which are pushed under the platform such that, during a further rotation of the platform, said platform slides along slopes of the raising wedges and is thus raised above the water surface.

16. The water amusement ride of claim 15, further comprising: coupling elements d which ensure that, when the platform is raised, the individual platforms are automatically jointly raised.

17. The water amusement ride of claim 14, wherein the raising device is composed of at least one run-on ramp, which is arranged under the platform and which extends in the direction of rotation, and of at least one supporting wheel, which is assigned to the platform and which can he displaced radially such that, during a further rotation of the platform, it runs onto the run-on ramp, whereby the platform is raised above the water surface.

18. The water amusement ride of claim 17, further comprising: coupling elements which ensure that, when the platform is raised, the individual platforms are automatically jointly raised.

19. A water amusement ride, comprising:

at least one water vessel which is movable in a body of water, which has seats for accommodating passengers;

a platform which, in a rest state of the water amusement ride, protrudes out of the water surface of the body of water and which, in an operating state, lies below the water surface; and a raising device which raises the platform and/or the individual platform out of the water surface in the rest state, wherein the raising device is composed of at least one run-on ramp, which is arranged under the platform and which extends in the direction of rotation, and of at least one supporting wheel, which is assigned to the platform and which can be displaced radially such that, during a further rotation of the platform, it runs onto the run-on ramp, whereby the platform is raised above the water surface;

coupling elements which ensure that, when the platform is raised, the individual platforms are automatically jointly raised.

* * * * *